US010596678B2

(12) United States Patent
Kinoshita

(10) Patent No.: US 10,596,678 B2
(45) Date of Patent: Mar. 24, 2020

(54) SHEET GLASS TOOL

(71) Applicant: NIPPON STEEL CHEMICAL & MATERIAL CO., LTD., Tokyo (JP)

(72) Inventor: Toshiya Kinoshita, Tokyo (JP)

(73) Assignee: NIPPON STEEL CHEMICAL & MATERIAL CO., LTD., Tokyo (JP)

( * ) Notice: Subject to any disclaimer, the term of this patent is extended or adjusted under 35 U.S.C. 154(b) by 120 days.

(21) Appl. No.: 15/536,848

(22) PCT Filed: Aug. 18, 2015

(86) PCT No.: PCT/JP2015/073081
§ 371 (c)(1),
(2) Date: Jun. 16, 2017

(87) PCT Pub. No.: WO2016/129136
PCT Pub. Date: Aug. 18, 2016

(65) Prior Publication Data

US 2017/0341199 A1 Nov. 30, 2017

(30) Foreign Application Priority Data

Feb. 10, 2015 (JP) ..... 2015-023852

(51) Int. Cl.
*B24B 9/10* (2006.01)
*B24D 3/06* (2006.01)

(52) U.S. Cl.
CPC . *B24B 9/10* (2013.01); *B24D 3/06* (2013.01)

(58) Field of Classification Search
CPC ..... H05R 1/02; H04J 1/00; B24B 9/10; B24D 3/06
See application file for complete search history.

(56) References Cited

U.S. PATENT DOCUMENTS

2002/0197947 A1* 12/2002 Sagawa ..... B24B 53/12 451/540
2013/0288582 A1* 10/2013 Chao ..... B24B 53/017 451/443
2014/0065401 A1* 3/2014 Donovan ..... C03C 21/002 428/220

FOREIGN PATENT DOCUMENTS

| | | |
|---|---|---|
| JP | 9-19868 | 1/1997 |
| JP | 2000-343436 | 12/2000 |
| JP | 2004-351655 | 12/2004 |
| JP | 2010-264566 | 11/2010 |
| JP | 2011-101942 | 5/2011 |
| JP | 2011-116118 | 6/2011 |
| JP | 2014-108479 | 6/2014 |
| WO | 2007/119886 | 10/2007 |

OTHER PUBLICATIONS

International Preliminary Report on Patentability dated Aug. 15, 2017 in International Application No. PCT/JP2015/073081.
International Search Report dated Oct. 13, 2015 in International Application No. PCT/JP2015/073081.

* cited by examiner

*Primary Examiner* — Timothy V Eley
(74) *Attorney, Agent, or Firm* — Wenderoth, Lind & Ponack, L.L.P.

(57) ABSTRACT

A sheet glass tool in which many abrasive grains are anchored in an anchoring layer formed on the tool tip, wherein a coolant flow channel is formed between a first abrasive grain and a second abrasive grain that are adjacent to each other.

10 Claims, 5 Drawing Sheets

SHEET GLASS TOOL

TECHNICAL FIELD

The present invention relates to a sheet glass tool for grinding glass sheets.

BACKGROUND ART

For glass covers to be used with mobile phones or tablet terminals, a thin glass sheet before or after being chemically tempered is employed. These glass sheets are cut from a large glass sheet in a shape slightly larger than the final shape, and then the outer periphery is cut, and holes are bored therein, for example, at loudspeaker and button positions.

Patent Literature 1 discloses a reduced-diameter grinding tool which is provided with a cylindrical reduced-diameter processing section having the surface to which diamond particles are adhered, and a shaft secured to a chuck (for example, see FIG. 11). Patent Literature 2 discloses a chamfering device for chamfering by pushing a chamfering drill, in which diamond abrasive grains are embedded, to the edge of an opening of a glass sheet.

When the glass sheet to be processed is ground using diamond abrasive grains, frictional heat may be generated causing seizure. Thus, coolant flow channels for flowing a coolant (for example, water) therethrough are formed between the diamond abrasive grains and an anchoring layer to which the grains are anchored, and the glass sheet.

Known methods for anchoring diamond abrasive grains to a drill and the like include a Ni electrodeposition method and a metal bonding method. The Ni electrodeposition method is a method in which diamond abrasive grains are secured by nickel plating. For example, a cloth bag filled with diamond abrasive grains is submerged in a nickel plating solution, and a wire penetrating the cloth bag is employed as a cathode so as to energize between the cathode and a nickel anode provided in the plating solution. The wire gradually increases in size while precipitating nickel in the diamond and plating solution. At this time, the diamond abrasive grains are captured in the nickel film so as to be lightly anchored to the surface of the wire. While this plating wire is slowly being wound, the aforementioned energization is continuously performed. The wire protruded from the cloth bag is subsequently plated in the plating solution until the precipitated nickel has a predetermined thickness.

The metal bonding method is a method in which metal powder and diamond abrasive grains are mixed and then heated to thereby sinter the metal powder, so that the diamond abrasive grains are anchored to the metal as being partially embedded in the metal.

FIG. 7 is a schematic cross-sectional view illustrating a diamond bonded portion of a sheet glass tool forced by a Ni electrodeposition method or a metal bonding method. A diamond abrasive grain 101 is anchored in a Ni electrodeposition layer (metal bonded layer) 102 and protruded from the Ni electrodeposition layer (metal bonded layer) 102. The tip of the diamond abrasive grain 101 protruded from the Ni electrodeposition layer (metal bonded layer) 102 is in contact with a glass sheet 103, and a coolant flow channel CL is formed between the Ni electrodeposition layer (metal bonded layer) 102 and the glass sheet 103.

In grinding a glass sheet using the sheet glass tool, the coolant is supplied into the coolant flow channel CL, thereby removing frictional heat during the grinding and thus preventing seizure. The coolant flow channel CL also serves to discharge chippings produced during the grinding and diamond abrasive grains dislodged from the tool.

CITATION LIST

Patent Literature

Patent Literature 1: Japanese Patent Application Laid-Open No. 2011-101942

Patent Literature 2: Japanese Patent Application Laid-Open No. 2004-351655

SUMMARY OF INVENTION

Technical Problem

However, in the aforementioned conventional configuration, 60 to 70% of the diamond abrasive grain 101 is embedded in the Ni electrodeposition layer (metal bonded layer) 102, and the upper end surface of the Ni electrodeposition layer (metal bonded layer) 102 extends generally horizontally along the glass sheet 103 that is in contact with the diamond abrasive grain 101. This led to a reduction in the flow channel area of the coolant flow channel CL and thus could not allow the cutting speed of the sheet glass tool to be sufficiently accelerated. It was also found that glass chips or diamonds dislodged from the tool were insufficiently discharged from the region being ground.

On the other hand, the flow channel area of the coolant flow channel CL increases to improve the cooling capacity, thereby increasing the cutting speed of the sheet glass tool. Furthermore, this prevents seizure, and thus allows longer service life of the sheet glass tool.

In this context, an object of the present invention is to expand the flow channel area of a coolant flow channel formed in a sheet glass tool and thus ensure a sufficient coolant flow, thereby improving production rate as well as providing longer service life to the tool.

Solution to Problem

To solve the aforementioned problems, a sheet glass tool according to the claimed invention is (1) a sheet glass tool having a number of abrasive grains anchored to an anchoring layer formed at a tool tip, the sheet glass tool being characterized in that a coolant flow channel is formed between a first abrasive grain and a second abrasive grain that are adjacent to each other, and when viewed in a flow channel direction of the coolant flow channel, the conditional expression [1] described below is satisfied:

$$S1/S \geq 0.35 \quad [1],$$

where S is an area of a region enclosed by a first imaginary line that passes through an apex of the first abrasive grain and extends in a thickness direction of the anchoring layer, a second imaginary line that passes through an apex of the second abrasive grain and extends in the thickness direction of the anchoring layer, a third imaginary line that connects the first apex and the second apex, and a fourth imaginary line that connects a bottom of the first abrasive grain and a bottom of the second abrasive grain, and S1 is an area of a region corresponding to the coolant flow channel.

(2) The sheet glass tool according to (1), characterized in that 65% or more of the surface area of the individual abrasive grain is covered with the anchoring layer.

(3) The sheet glass tool according to (1) or (2), characterized in that the anchoring layer is formed from a brazing material.

(4) The sheet glass tool according to (1) or (2), characterized in that the anchoring layer is composed of a plurality of first plated layers in which lower end portions of the abrasive grains are individually embedded, and a second plated layer that covers the first plated layers and extends to the entire tool tip, and the lower end portion of the abrasive grain is located above a lower end surface of the first plated layers.

(5) The sheet glass tool according to one of (1) to (4), characterized in that the sheet grass tool is composed of an increased-diameter portion having a generally constant diameter, a reduced-diameter portion having a generally constant diameter, and a tapered portion for connecting the increased-diameter portion and the reduced-diameter portion, and the anchoring layer is formed on a lower end portion of the increased-diameter portion, on the reduced-diameter portion, and on the tapered portion.

(6) The sheet glass tool according to one of (1) to (4), characterized in that the sheet glass tool is composed of an increased-diameter portion having a constant diameter, a reduced-diameter portion having a chamfered groove, and a tapered portion connecting the increased-diameter portion and the reduced-diameter portion, and the anchoring layer is formed on the lower end portion of the increased-diameter portion, on the reduced-diameter portion, and on the tapered portion.

Advantageous Effects of Invention

According to the present invention, it is possible to expand the flow channel area of a coolant flow channel formed in a sheet glass tool so as to ensure a sufficient coolant flow, thereby providing an improved production rate and longer tool service life.

DESCRIPTION OF EMBODIMENTS

First Embodiment

Figure 1:
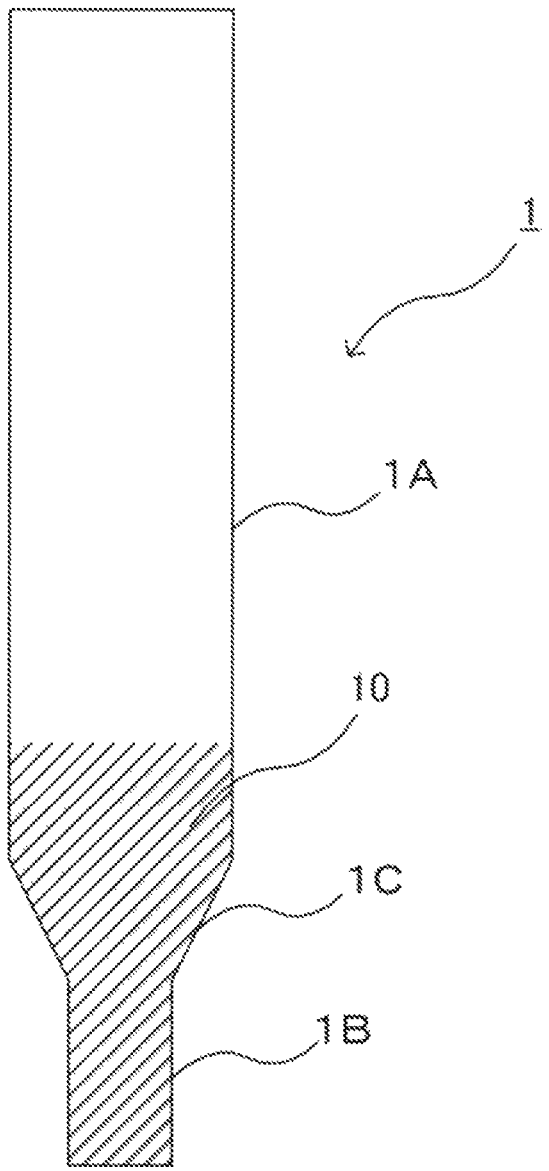
FIG. 1 is a schematic view illustrating a shank (for drilling).

With reference to the drawings, a description will be given of an embodiment of the present invention. FIG. 1 is a schematic view illustrating a shank 1 acting as a sheet glass tool. The shank 1 is composed of an increased-diameter portion 1A, a reduced-diameter portion 1B, and a tapered portion 1C. The increased-diameter portion 1A and the reduced-diameter portion 1B each have a constant diameter. The tapered portion 1C has an upper end coupled to the lower end of the increased-diameter portion 1A and a lower end coupled to the upper end of the reduced-diameter portion 1B. The shank 1 can be used to form a hole in a glass sheet. The glass sheet may be, for example, a glass cover of a mobile phone. By lowering the shank 1, while being rotated, to the glass cover of a mobile phone, an opening for a loudspeaker and the like can be formed.

Figure 2:
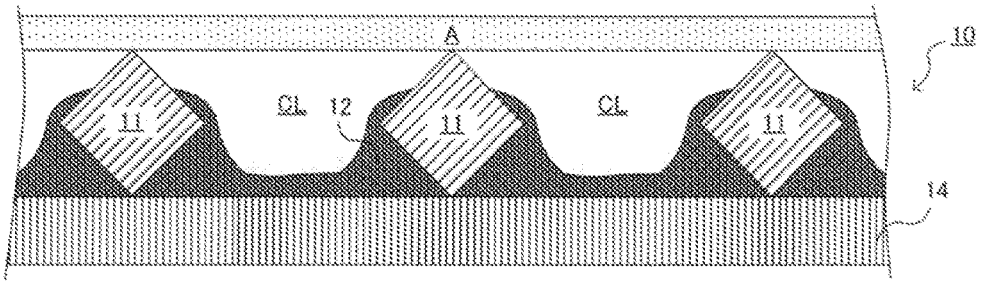
FIG. 2 is an enlarged cross-sectional view illustrating part of a diamond bonded portion.

The hatched area of the shank 1 is a diamond bonded portion 10, and a number of diamond abrasive grains 11 are anchored to the diamond bonded portion 10. It is possible to employ artificial diamond abrasive grains for the diamond abrasive grains 11. FIG. 2 is an enlarged cross-sectional view illustrating part of the diamond bonded portion 10. The diamond abrasive grains 11 are anchored to an anchoring layer 12 formed on a tool base 14. The anchoring layer 12 is formed so as to climb up the diamond abrasive grains 11. That is, the anchoring layer 12 is formed in a manner such that the thickness thereof is relatively thick in a region in close proximity to the diamond abrasive grains 11 and relatively thin in a region spaced apart from the diamond abrasive grains 11. Note that it is possible to employ stainless steel, carbon steel, molybdenum steel, or an alloy thereof for the tool base 14.

When the surface area of the diamond abrasive grains 11 is defined as 100%, the ratio of the diamond abrasive grains 11 to be embedded in the anchoring layer 12 is preferably 65% or greater. That is, the thickness of the anchoring layer 12 may be preferably controlled so that 65% or greater of the entire surface area of the diamond abrasive grains 11 is to be anchored to the anchoring layer 12. When the anchoring ratio of the diamond abrasive grains 11 to be anchored to the anchoring layer 12 is less than 65%, the service life of the tool is shortened due to degradation in the anchoring force for anchoring the diamond abrasive grains 11.

The diamond abrasive grains 11 preferably have a grain size of 2 μm or more and 150 μm or less. If the diamond abrasive grains 11 have a grain size of less than 2 μm, the processing speed is insufficient. The diamond abrasive grains 11 having a grain size exceeding 150 μm cause too big chippings to occur after processing. For these reasons, the diamond abrasive grains 11 have preferably a grain size of 2 μm or more and 150 μm or less. When prime importance is placed on the size of chippings after processing, the range of grain sizes of the diamond abrasive grains 11 may be more limited to, i.e., desirably 5 μm or more and 50 μm or less.

The anchoring layer 12 may be formed from a brazing material. Since the brazing material and the diamond abrasive grains 11 have a high affinity, the brazing material can climb up the diamond abrasive grains 11 to readily form the anchoring layer 12 with bumps and dips that are relatively thick in a region in close proximity to the diamond abrasive grains 11 and relatively thin in a region spaced apart from the diamond abrasive grains 11. The region of the anchoring layer 12 of a greater thickness has a bent surface. This makes it possible to increase the heat radiating area of the anchoring layer 12 that is provided in a region in close proximity to the diamond abrasive grains 11. This thus ensures more effective heat removal from a cutting region.

The tip end of the diamond abrasive grains 11 is in contact with a glass sheet A so as to form a coolant flow channel CL by a region that is enclosed by the anchoring layer 12, the protruded portions of the diamond abrasive grains 11 protruded from the anchoring layer 12, and the glass sheet A. As mentioned above, use of the brazing material allows a large gap to be formed in a region immediately below the glass sheet A other than the regions of the diamond abrasive grains 11, and the large gap can be employed as the coolant flow channel CL. This allows for sufficiently cooling a region being ground while the diamond abrasive grains 11 are robustly secured to the anchoring layer 12.

Figure 3:
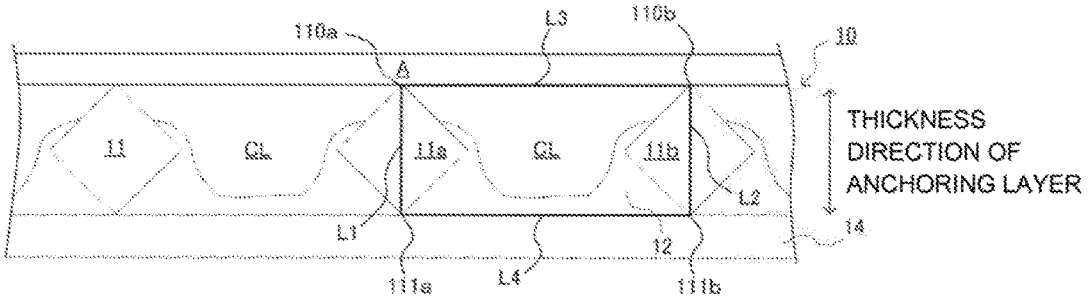
FIG. 3 is an explanatory view corresponding to FIG. 2 and illustrating the area of a coolant flow channel CL.

Referring to FIG. 3, a description will be given of the area of the coolant flow channel CL in detail. FIG. 3 is an explanatory view corresponding to FIG. 2 and illustrating the area of the coolant flow channel CL. The rectangular region denoted by a solid line is a reference region that is compared with so as to quantitatively express the ratio of the flow channel cross-sectional area S1 of the coolant flow channel CL formed between the adjacent abrasive grains 11.

For convenience, adjacent diamond abrasive grains 11*a* and 11*b* are to be referred to as the first diamond abrasive grain 11*a* and the second diamond abrasive grain 11*b*, respectively. Furthermore, for convenience, it is assumed that the line that passes through an apex 110*a* of the first diamond abrasive grain 11*a* and extends in the thickness direction of the anchoring layer 12 is referred to as a first imaginary line L1, the line that passes through an apex 110*b* of the second diamond abrasive grain 11*b* and extends in the thickness direction of the anchoring layer 12 is referred to as a second imaginary line L2, the line that connects the apex 110*a* of the first diamond abrasive grain 11*a* and the apex 110*b* of the second diamond abrasive grain 11*b* is referred to as a third imaginary line L3, and the line that connects a bottom 111*a* of the first diamond abrasive grain 11*a* and a bottom 111*b* of the second diamond abrasive grain 11*b* is referred to as a fourth imaginary line L4. The apex 110*a* of the first diamond abrasive grain 11*a* (the apex 110*b* of the second diamond abrasive grain 11*b*) is the portion of the first diamond abrasive grain 11*a* (the second diamond abrasive grain 11*b*) that is in contact with the glass sheet A. The bottom 111*a* of the first diamond abrasive grain 11*a* (the bottom 111*b* of the second diamond abrasive grain 11*b*) is the end of the first diamond abrasive grain 11*a* (the second diamond abrasive grain 11*b*) closer to the tool base 14.

Here, when S is the area of a rectangular region (hereafter referred to as the reference area) enclosed by the first imaginary line L1, the second imaginary line L2, the third imaginary line L3, and the fourth imaginary line L4, and S1 is the area of a region corresponding to the coolant flow channel CL (hereafter referred to as the coolant area), S1/S is 0.35 or greater, and preferably 0.45 or greater.

Setting the S1/S, which is the ratio of the reference area and the coolant area, to 0.35 or greater can increase the processing speed because of an increase in the amount of the coolant. Furthermore, even when the processing speed is increased, the degradation of the service life of the tool can be reduced because the region being ground can be sufficiently cooled with the coolant. Setting the S1/S to 0.45 or greater noticeably increases the effects of higher processing speeds and longer service life of the tool.

A description will now be given of a method for manufacturing the diamond bonded portion 10. The diamond bonded portion 10 can be formed by a brazing method. The brazing method will be explained in detail.

The brazing materials that can be employed include a nickel base alloy which contains 0.5 to 20 wt % of one or more types of metals selected from among, for example, titanium, chromium, and zirconium, and has a melting point of 650° C. to 1200° C. In this case, a layer of a carbide including one or more types of metals selected from among titanium, chromium, and zirconium can be formed on the interface between the diamond abrasive grains 11 and the anchoring layer 12.

The diamond abrasive grains 11 and the brazing material are adhered to the tool base 14 with glue. The diamond abrasive grains 11 are adhered thereto in a single layer. The amount of the brazing material used can be set so as to increase with increasing grain sizes of the diamond abrasive grains 11 up to the limit at which the diamond abrasive grains 11 are not buried. The amount of the brazing material used can be varied to vary the thickness of the anchoring layer 12, thereby controlling the S1/S that is the ratio of the reference area and the coolant area.

Next, the tool base 14 to which the diamond abrasive grains 11 and the brazing material have been adhered is vacuumed under a pressure of about $10^{-5}$ Torr, and after that heated up to a temperature at which the brazing material is melted. The brazing material is heated at the melting point of the brazing material or higher, but preferably at as low temperature as possible, for example, preferably within the liquid-phase line temperature +20° C. This is because too high heating temperature of the brazing material would cause an increase in the thermal distortion of the tool base 14.

Furthermore, the heating time is preferably 5 to 30 minutes. The aforementioned heating makes it possible to constitute the anchoring layer 12 having a recessed and projected structure with the brazing material climbed up the diamond abrasive grains 11.

According to the configuration of this embodiment, since the ratio of the coolant area S1 to the reference area S is 0.35 or greater, the amount of a coolant can be increased. This allows for increasing the processing speed. On the other hand, even with an increase in the processing speed, the degradation of the tool service life can be reduced because the region being ground can be sufficiently cooled with the coolant. Furthermore, the cuttings produced during grinding (glass sheet chippings, and tool cuttings) can be readily discharged through the coolant flow channel CL.

The sheet glass tool of this embodiment was used to try to process the glass cover of a mobile phone. When compared with the conventional tool shown in FIG. 7, under the same processing conditions, the processing speed was three times or greater and the tool service life was twenty times or greater.

Second Embodiment

Figure 4:
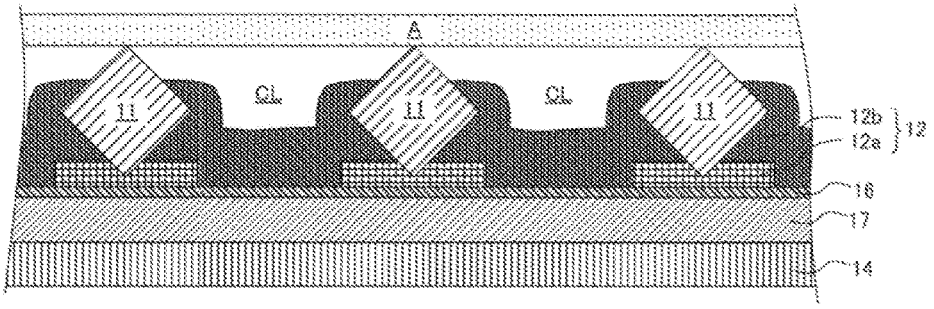
FIG. 4 is an enlarged cross-sectional view illustrating part of a diamond bonded portion (second embodiment).
Figure 5:
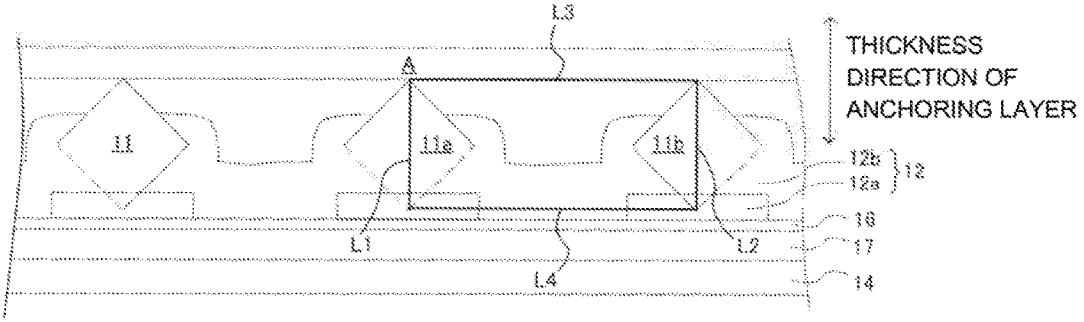
FIG. 5 is an explanatory view corresponding to FIG. 4 and illustrating the area of a coolant flow channel CL.

Now, referring to FIGS. 4 and 5, a description will be given of a sheet glass tool of a second embodiment. FIG. 4 is an enlarged sectional view illustrating part of the diamond bonded portion 10. FIG. 5 is an explanatory view corresponding to FIG. 4 and illustrating the area of the coolant flow channel CL. Those components having the same function as that of the first embodiment are denoted by the same symbol.

The anchoring layer 12 is composed of a plurality of primary plated layers 12*a* (equivalent to the first plated layers) and an embedded plated layer 12*b* (equivalent to the second plated layer). The lower end portions of the diamond abrasive grains 11 are embedded in the respective primary plated layers 12*a* and located above the lower end surfaces of the primary plated layers 12*a*. The embedded plated layer 12*b* covers the primary plated layers 12*a* and extends across the entirety of the diamond bonded portion 10.

Furthermore, of the embedded plated layer 12*b*, the portion generally immediately above the primary plated layers 12*a* is formed in a projected shape, and the other region is formed in a recessed shape. That is, the primary plated layers 12*a* are provided to thereby form a step height on the embedded plated layer 12*b*, which allows the coolant flow channel CL formed between the glass sheet A and the embedded plated layer 12*b* to have a greater flow channel cross-sectional area.

With reference to FIG. 5, when S is the area of a rectangular region (hereafter referred to as the reference area) enclosed by the first imaginary line L1, the second imaginary line L2, the third imaginary line L3, and the fourth imaginary line L4, and S1 is the area of a region corresponding to the coolant flow channel CL (hereafter referred to as the coolant area), S1/S is 0.35 or greater, preferably 0.45 or greater. The meaning of the first imaginary line L1, the second imaginary line L2, the third imaginary line L3, and the fourth imaginary line L4 has the same meaning as that of the first embodiment, and thus will not be explained repeatedly.

Setting the S1/S, which is the ratio of the reference area and the coolant area, to 0.35 or greater can increase the processing speed because of an increase in the amount of the coolant. Furthermore, even when the processing speed is increased, the degradation of the service life of the tool can be reduced because the region being ground can be sufficiently cooled with the coolant. Setting the S1/S to 0.45 or greater noticeably increases the effects of higher processing speeds and longer service life of the tool.

The lower portion of the diamond abrasive grains 11 is covered with the primary plated layers 12*a*, and the other portion (however, except for the apex of the diamond abrasive grains 11) is covered with the embedded plated layer 12*b*. Assuming that the surface area of each of the diamond abrasive grains 11 is 100%, the ratio of the diamond abrasive grain 11 being embedded in the anchoring layer 12 is preferably 65% or greater. When the anchoring ratio of the diamond abrasive grain 11 being anchored to the anchoring layer 12 is less than 65%, the tool service life is shortened because of degradation in the anchoring force for anchoring the diamond abrasive grain 11.

The anchoring layer 12 is formed on top of a nickel strike plated layer 16, the nickel strike plated layer 16 is formed on top of a base nickel plated layer 17, and the base nickel plated layer 17 is formed on top of the tool base 14.

The diamond bonded portion 10 of this embodiment can be manufactured by a two-stage nickel electrodeposition method. That is, the tool base 14 is subjected to a jet of a plating solution through a nozzle to thereby form the base nickel plated layer 17. The base nickel plated layer 17 may have a thickness of 30 μm. Next, the base nickel plated layer 17 is subjected to a jet of a plating solution through a nozzle to thereby form the nickel strike plated layer 16. The nickel strike plated layer 16 may have a thickness of 0.5 μm.

Now, the primary plated layers 12*a* are formed on top of the nickel strike plated layer 16 to temporarily anchor the diamond abrasive grains 11, and after that the embedded plated layer 12*b* is formed by a jet of a plating solution through a nozzle.

The sheet glass tool of this embodiment was used to try to process the glass cover of a mobile phone. When compared with the conventional tool shown in FIG. 7, under the same processing conditions, the processing speed was two times or greater and the tool service life was five times or greater.

MODIFIED EXAMPLES

A description was given of the shank 1 for drilling holes in the embodiments described above. However, the present invention is not limited thereto, and may also be applicable to a shank 30 of FIG. 6. The shank 30 is composed of an increased-diameter portion 30A, a tapered portion 30B, and a reduced-diameter portion 30C. The increased-diameter portion 30A has a constant diameter size. The tapered portion 30B is consecutively connected to the lower end of the increased-diameter portion 30A and is gradually reduced in diameter toward the lower side. The reduced-diameter portion 30C is formed at the lower end of the tapered portion 30B. A chamfering groove 301C that is bent inwardly in the radial direction is formed at some midpoint of the reduced-diameter portion 30C. A diamond bonded portion 40 denoted by hatching is formed on the lower end portion of the increased-diameter portion 30A, the tapered portion 30B, and the reduced-diameter portion 30C. The configurations of the first and second embodiments can be applied to the diamond bonded portion 40.

Now, the present invention will be described in detail with reference to examples.

Example 1

In Example No. 1, the diamond bonded portion 10 was formed on the shank 1 of FIG. 1 by a brazing method. The diamond abrasive grains 11 had a grain size of 40 μm. As the tool base 14, a stainless steel was employed. As the brazing material to be used for the anchoring layer 12, a Ni base alloy that contained Cr, Fe, Si, B, and P was employed. The tool base 14 to which the diamond abrasive grains 11 and the brazing material were adhered was vacuumed under a pressure of $10^{-5}$ Torr and heated for 20 minutes in a vacuum. The heating temperature was set to 1000° C.

In Example No. 2, the diamond bonded portion was formed on the shank 1 of FIG. 1 by a two-stage nickel electrodeposition method. The diamond abrasive grains 11 had a grain size of 40 μm. As the tool base 14, a stainless steel was employed. The configuration of the diamond bonded portion 10 is the same as that of the second embodiment, and thus will not be explained repeatedly.

Figure 7:
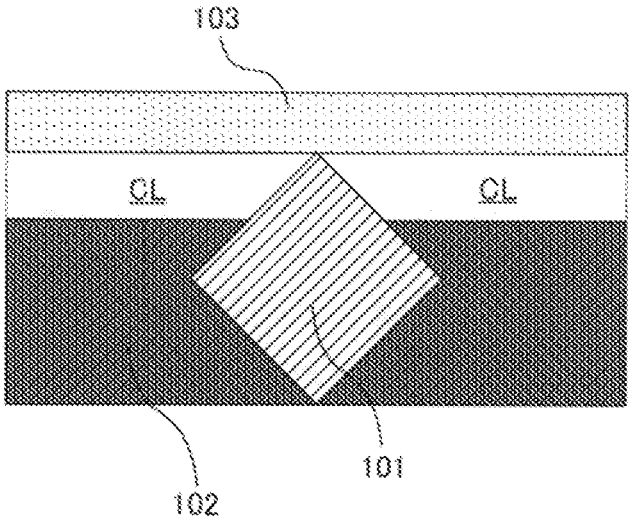
FIG. 7 is an enlarged view illustrating part of a conventional diamond bonded portion.

In Comparative Example No. 1, the diamond bonded portion was formed on the shank 1 of FIG. 1 by a nickel electrodeposition method. Diamond abrasive grains 101 had a grain size of 40 μm. As the tool base, a stainless steel was employed. As illustrated in FIG. 7, an anchoring layer 102 had a flat upper end surface.

In Comparative Example No. 2, the diamond bonded portion was formed on the shank 1 of FIG. 1 by a metal bonding method. The diamond abrasive grains 101 had a grain size of 40 μm. As the tool base, a stainless steel was employed. As illustrated in FIG. 7, the anchoring layer 102 had a flat upper end surface.

These different sheet glass tools were used for drilling holes on a mobile-phone glass cover. The processing conditions were as follows.

Glass size: 50 mm×100 mm×0.55 mm
Glass material: chemically tempered glass
Hole shape: elongated hole of 1.0 mm×9.8 mm
Tool RPM: 30000 rpm
Tool feed speed: 60 mm/min
Depth of cut in sheet thickness direction: 0.05 mm The number of holes made by drilling under the same processing conditions was evaluated for comparison of tool service lives. When the number of holes formed before the tool service life was reached was 900 or more, the long service life performance was evaluated to be "very good." For the number of holes being 350 or more and less than 900, the long service life performance was evaluated to be "good." When the number of holes is less than 350, the long service life performance was evaluated as "poor." These results were shown in Table 1.

TABLE 1

| SAMPLE No. | S1/S | COVERING RATIO | SERVICE LIFE (HOLE) | EVALUATION |
|---|---|---|---|---|
| EXAMPLE No. 1 | 0.56 | 88% | 4500 | very good |
| EXAMPLE No. 2 | 0.44 | 77% | 850 | good |
| COMPARATIVE EXAMPLE No. 1 | 0.22 | 75% | 120 | poor |
| COMPARATIVE EXAMPLE No. 2 | 0.25 | 69% | 160 | poor |

In drilling holes for a mobile-phone glass cover, the service life of the sheet glass tool according to Example No. 1 was 20 times or longer than that of the tools according to Comparative Examples No. 1 and No. 2. The service life of the sheet glass tool according to Example No. 2 was five times or longer than that of the tools according to Comparative Examples No. 1 and No. 2. Furthermore, from Examples No. 1 and No. 2, it was found that setting the covering ratio (the ratio of diamond abrasive grains being embedded in the anchoring layer when the surface area of an individual diamond abrasive grain is assumed to be 100%) to 65% or greater led to an effectively elongated service life. On the other hand, from Comparative Examples No. 1 and No. 2, it was found that setting the covering ratio even to 65% or greater could not prevent deterioration of service life because the S1/S was below 0.35.

Example 2

Figure 6:
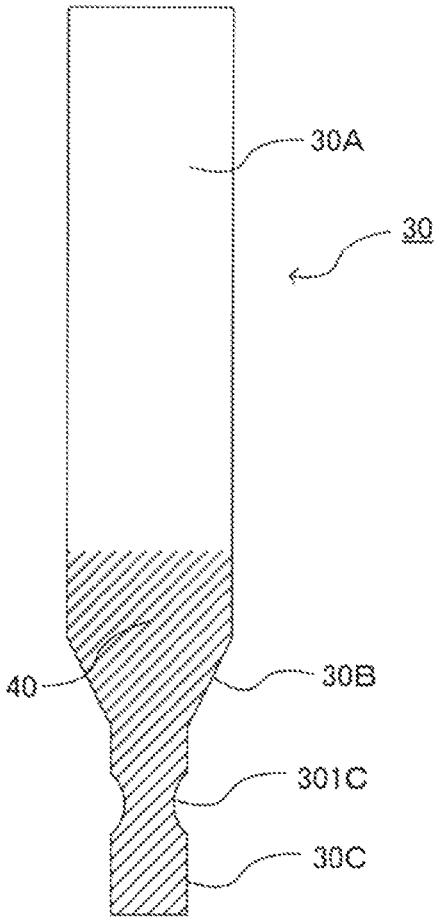
FIG. 6 is a schematic view illustrating a shank (for chamfering).

In Example No. 3, the diamond bonded portion was formed on the shank 30 of FIG. 6 by a brazing method. The diamond abrasive grains 11 had a grain size of 9 μm. As the tool base, a stainless steel was employed. As the brazing material to be used for the anchoring layer 12, a Ni base alloy that contained Cr, Fe, Si, B, and P was employed. The tool base to which the diamond abrasive grains 11 and the brazing material were adhered was vacuumed under a pressure of $10^{-5}$ Torr and heated for 20 minutes in a vacuum. The heating temperature was set to 1000° C.

In Example No. 4, the diamond bonded portion 40 was formed on the shank 30 of FIG. 6 by a two-stage nickel electrodeposition method. The diamond abrasive grains 11 had a grain size of 9 μm. As the tool base, a stainless steel was employed. The configuration of the diamond bonded portion 40 is the same as that of the second embodiment, and thus will not be explained repeatedly.

In Comparative Example No. 3, the diamond bonded portion was formed on the shank 30 of FIG. 6 by a nickel electrodeposition method. The diamond abrasive grains 101 had a grain size of 9 μm. As the tool base, a stainless steel was employed. As illustrated in FIG. 7, the anchoring layer 102 had a flat upper end surface.

In Comparative Example No. 4, the diamond bonded portion was formed on the shank 30 of FIG. 6 by a metal bonding method. The diamond abrasive grains 101 had a grain size of 9 μm. As the tool base, a stainless steel was employed. As illustrated in FIG. 7, the anchoring layer 102 had a flat upper end surface.

These different sheet glass tools were used for chamfering of elongated holes formed on a mobile-phone glass cover. The processing conditions were as follows.

Glass size: 50 mm×100 mm×0.55 mm
Glass material: chemically tempered glass
Hole shape: elongated holes of 1.0 mm×9.8 mm were chamfered into elongated holes of 1.2 mm×10.0 mm.
Tool RPM: 30000 rpm
Tool feed speed: 60 mm/min
Depth of cut: 0.10 mm The number of holes made by drilling under the same processing conditions was evaluated for comparison of tool service lives. The evaluation reference was the same as that of Example 1. These results were shown in Table 2.

TABLE 2

| SAMPLE No. | S1/S | COVERING RATIO | SERVICE LIFE (HOLE) | EVALUATION |
|---|---|---|---|---|
| EXAMPLE No. 3 | 0.53 | 90% | 1500 | very good |
| EXAMPLE No. 4 | 0.41 | 71% | 400 | good |
| COMPARATIVE EXAMPLE No. 3 | 0.18 | 78% | 60 | poor |
| COMPARATIVE EXAMPLE No. 4 | 0.17 | 72% | 70 | poor |

In the chamfering of a mobile-phone glass cover, the service life of the sheet glass tool according to Example No. 3 was 20 times or longer than that of the tools according to Comparative Examples No. 3 and No. 4. The service life of the sheet glass tool according to Example No. 4 was five times or longer than that of the tools according to Comparative Examples No. 3 and No. 4. Furthermore, from Examples No. 3 and No. 4, it was found that setting the covering ratio (the ratio of diamond abrasive grains being embedded in the anchoring layer when the surface area of an individual diamond abrasive grain is assumed to be 100%) to 65% or greater led to an effectively elongated service life. On the other hand, from Comparative Examples No. 3 and No. 4, it was found that setting the covering ratio even to 65% or greater could not prevent deterioration of service life because the S1/S was below 0.35.

Example 3

In Example No. 5, the diamond bonded portion 10 was formed on the shank 1 of FIG. 1 by a brazing method. The diamond abrasive grains 11 had a grain size of 30 μm. As the tool base 14, a stainless steel was employed. As the brazing material to be used for the anchoring layer 12, a Ni base alloy that contained Cr, Fe, Si, B, and P was employed.

In Example No. 6, the diamond bonded portion was formed on the shank 1 of FIG. 1 by a two-stage nickel electrodeposition method. The diamond abrasive grains 11 had a grain size of 30 μm. As the tool base 14, a stainless steel was employed.

In Comparative Example No. 5, the diamond bonded portion was formed on the shank 1 of FIG. 1 by a nickel electrodeposition method. The diamond abrasive grains 101 had a grain size of 30 μm. As the tool base, a stainless steel was employed. As illustrated in FIG. 7, the anchoring layer 102 had a flat upper end surface.

In Comparative Example No. 6, the diamond bonded portion was formed on the shank 1 of FIG. 1 by a metal bonding method. The diamond abrasive grains 101 had a grain size of 30 μm. As the tool base, a stainless steel was employed. As illustrated in FIG. 7, the anchoring layer 102 had a flat upper end surface.

These different sheet glass tools were used for drilling holes on a mobile-phone glass cover. The processing conditions were as follows.

Glass size: 50 mm×100 mm×0.55 mm
Glass material: chemically tempered glass
Hole shape: elongated hole of 1.0 mm×9.8 mm
Tool RPM: 30000 rpm
Depth of cut in sheet thickness direction: 0.05 mm The tool feed speed for drilling holes under the same processing conditions was evaluated for comparison of processing speeds. The tool feed speed was determined to be the limit tool feed speed when the grindstone was seized or could not perform processing any more at speeds greater than that speed or when chippings became 100 um or greater in size. For a processing speed of 250 mm/min or greater, the processing speed performance was evaluated to be "very good." For a processing speed of 150 mm/min or greater and less than 250 mm/min, the processing speed performance was evaluated to be "good." For a processing speed of less than 150 mm/min, the processing speed performance was evaluated to be "poor." These results were shown in Table 3.

TABLE 3

| SAMPLE No. | S1/S | COVERING RATIO | FEED SPEED (mm/min) | EVALUATION |
|---|---|---|---|---|
| EXAMPLE No. 5 | 0.60 | 91% | 360 | very good |
| EXAMPLE No. 6 | 0.42 | 79% | 170 | good |
| COMPARATIVE EXAMPLE No. 5 | 0.20 | 78% | 70 | poor |
| COMPARATIVE EXAMPLE No. 6 | 0.19 | 70% | 80 | poor |

In drilling holes for a mobile-phone glass cover, the processing speed of the sheet glass tool according to Example No. 5 was three times or greater than that of the tools according to Comparative Examples No. 5 and No. 6. The processing speed of the sheet glass tool according to Example No. 6 was twice or greater than that of the tools according to Comparative Examples No. 5 and No. 6.

The invention claimed is:

1. A sheet glass tool comprising a number of abrasive grains each having a grain size of 2 μm or more and 150 μm or less and anchored to an anchoring layer formed at a tool tip, wherein a coolant flow channel is formed between a first abrasive grain and a second abrasive grain that are adjacent to each other, 65% or more of the surface area of each individual abrasive grain is covered with a brazing material used to form the anchoring layer, the anchoring layer is formed in a manner such that the thickness thereof is thick in a region in close proximity to the abrasive grains and thinner than the region in close proximity to the abrasive grains in a region spaced apart from the abrasive grains so as to climb up the abrasive grains, and when viewed in a flow channel direction of the coolant flow channel, the conditional expression [1] described below is satisfied:

$$S1/S \geq 0.45 \quad [1],$$

where S is an area of a region enclosed by a first imaginary line that passes through an apex of the first abrasive grain and extends in a thickness direction of the anchoring layer, a second imaginary line that passes through an apex of the second abrasive grain and extends in the thickness direction of the anchoring layer, a third imaginary line that connects the apex of the first abrasive grain and the apex of the second abrasive grain, and a fourth imaginary line that connects a bottom of the first abrasive grain and a bottom of the second abrasive grain, and S1 is an area of a region corresponding to the coolant flow channel.

2. The sheet glass tool according to claim 1, wherein the anchoring layer is composed of a plurality of first plated layers in which lower end portions of the abrasive grains are individually embedded, and a second plated layer that covers the first plated layers and extends to the tool tip, and the lower end portions of the abrasive grains are located above a lower end surface of the first plated layers.

3. The sheet glass tool according to claim 2, wherein the sheet glass tool is composed of an increased-diameter portion having a generally constant diameter, a reduced-diameter portion having a generally constant diameter, and a tapered portion for connecting the increased-diameter portion and the reduced-diameter portion, wherein the increased-diameter portion has a larger diameter than the reduced-diameter portion, and the anchoring layer is formed on a lower end portion of the increased-diameter portion, on the reduced-diameter portion, and on the tapered portion.

4. The sheet glass tool according to claim 2, wherein the sheet glass tool is composed of an increased-diameter portion having a constant diameter, a reduced-diameter portion having a chamfered groove, and a tapered portion connecting the increased-diameter portion and the reduced-diameter portion, wherein the increased-diameter portion has a larger diameter than the reduced-diameter portion, and the anchoring layer is formed on a lower end portion of the increased-diameter portion, on the reduced-diameter portion, and on the tapered portion.

5. The sheet glass tool according to claim 1, wherein the sheet glass tool is composed of an increased-diameter portion having a generally constant diameter, a reduced-diameter portion having a generally constant diameter, and a tapered portion for connecting the increased-diameter portion and the reduced-diameter portion, wherein the increased-diameter portion has a larger diameter than the reduced-diameter portion, and the anchoring layer is formed on a lower end portion of the increased-diameter portion, on the reduced-diameter portion, and on the tapered portion.

6. The sheet glass tool according to claim 1, wherein the sheet glass tool is composed of an increased-diameter portion having a constant diameter, a reduced-diameter portion having a chamfered groove, and a tapered portion connecting the increased-diameter portion and the reduced-diameter portion, wherein the increased-diameter portion has a larger diameter than the reduced-diameter portion, and the anchoring layer is formed on a lower end portion of the increased-diameter portion, on the reduced-diameter portion, and on the tapered portion.

7. A sheet glass tool comprising a number of abrasive grains each having a grain size of 2 μm or more and 150 μm or less and anchored to an anchoring layer formed at a tool tip, wherein the anchoring layer is composed of a plurality of first plated layers in which lower end portions of the abrasive grains are individually embedded, and a second plated layer that covers the first plated layers and extends to the tool tip, the lower end portions of the abrasive grains are located above a lower end surface of the first plated layers, the second plated layer has a surface formed into a step shape in which a region in close proximity to the abrasive grains is at a higher level and a region spaced apart from the abrasive grains is at a lower level than the region in close proximity to the abrasive grains, a coolant flow channel is formed between a first abrasive grain and a second abrasive grain that are adjacent to each other, 65% or more of the surface area of each individual abrasive grain is covered with the anchoring layer, and when viewed in a flow channel direction of the coolant flow channel, the conditional expression [1] described below is satisfied:

$$S1/S \geq 0.35 \quad [1],$$

where S is an area of a region enclosed by a first imaginary line that passes through an apex of the first abrasive grain and extends in a thickness direction of the anchoring layer, a second imaginary line that passes through an apex of the second abrasive grain and extends in the thickness direction of the anchoring layer, a third imaginary line that connects the apex of the first abrasive grain and the apex of the second abrasive grain, and a fourth imaginary line that connects a bottom of the first abrasive grain and a bottom of the second abrasive grain, and S1 is an area of a region corresponding to the coolant flow channel.

8. The sheet glass tool according to claim 7, wherein the anchoring layer is formed from a brazing material.

9. The sheet glass tool according to claim 7, wherein the sheet glass tool is composed of an increased-diameter portion having a generally constant diameter, a reduced-diameter portion having a generally constant diameter, and a tapered portion for connecting the increased-diameter portion and the reduced-diameter portion, wherein the increased-diameter portion has a larger diameter than the reduced-diameter portion, and the anchoring layer is formed on a lower end portion of the increased-diameter portion, on the reduced-diameter portion, and on the tapered portion.

10. The sheet glass tool according to claim 7, wherein the sheet glass tool is composed of an increased-diameter portion having a constant diameter, a reduced-diameter portion having a chamfered groove, and a tapered portion connecting the increased-diameter portion and the reduced-diameter portion, wherein the increased-diameter portion has a larger diameter than the reduced-diameter portion, and the anchoring layer is formed on a lower end portion of the increased-diameter portion, on the reduced-diameter portion, and on the tapered portion.

* * * * *